United States Patent [19]

Hentschel et al.

[11] Patent Number: 4,490,266

[45] Date of Patent: Dec. 25, 1984

[54] PROCESS FOR THE PREPARATION OF LIQUIDS OF LOW INFLAMMABILITY AND HIGH VISCOSITY INDEX AND THE USE THEREOF

[75] Inventors: Karl-Heinz Hentschel, Krefeld; Bernhard Müssig, Seevetal; Rolf Dhein, Krefeld; Siegfried Kussi, Leverkusen, all of Fed. Rep. of Germany

[73] Assignee: Bayer Aktiengesellschaft, Leverkusen, Fed. Rep. of Germany

[21] Appl. No.: 497,529

[22] Filed: May 24, 1983

[30] Foreign Application Priority Data

Jun. 4, 1982 [DE] Fed. Rep. of Germany ..... 3221137

[51] Int. Cl.[3] ..... C10M 1/46; C10M 1/26

[52] U.S. Cl. ..... 252/49.8; 252/56 R; 252/78.5

[58] Field of Search ..... 252/49.8, 56 R, 78

[56] References Cited

U.S. PATENT DOCUMENTS

| | | | |
|---|---|---|---|
| 3,867,298 | 2/1975 | Malec | 252/49.8 |
| 3,935,116 | 1/1976 | Sheratte | 252/49.8 |
| 3,951,837 | 4/1976 | Sheratte | 252/49.8 |

*Primary Examiner*—Jacqueline V. Howard

*Attorney, Agent, or Firm*—Sprung Horn Kramer & Woods

[57] ABSTRACT

A composition comprising 96–99.9% by weight of a highly flame-resistant base oil such as an aromatic phosphate ester or a polychlorinated aromatic compound and a polyester of molecular weight, 20,000 to 300,000, derived from polytetramethylene glycol, for instance. The composition has an improved viscosity index and is especially useful as a HSD lubricant. It is also useful as a hydraulic fluid and/or heat transfer liquid. By addition of such a polyester to such base oil, the viscosity index of the base oil is considerably improved.

19 Claims, No Drawings

PROCESS FOR THE PREPARATION OF LIQUIDS OF LOW INFLAMMABILITY AND HIGH VISCOSITY INDEX AND THE USE THEREOF

The invention relates to a process for the preparation of liquids of low inflammability and high viscosity index, and the use thereof as hydraulic fluids and/or heat transfer liquids. The following types of hydraulic fluids of low inflammability are known and are defined in the 5th Luxembourg Report on the requirements and testing of fluids of low inflammability for hydraulic power transmission and control (1974):

HSA: Oil-in-water emulsions having a combustible content of not more than 20%, operating temperature from +5° to +55° C.

HSB: Water-in-oil emulsions having a combustible content of not more than 60%. Operating temperature from +5° to +60° C.

HSC: Aqueous polymer solutions containing at least 35% of water. Operating temperature from −20° to +60° C.

HSD: Anhydrous liquids. Operating temperature from −20° to +150° C.

The types HSA, HSB and HSC contain varying amounts of water. This can lead to problems in relation to adequate corrosion resistance. Furthermore, systems operated on these hydraulic fluids can be exposed to increased wear at highly loaded points of friction. In addition, there is a risk of contamination with microorganisms, as a result of which the properties of the products can become poorer (Ullmanns Encyklopädie der technischen Chemie ["Ullmann's Encyclopaedia of Industrial Chemistry"], Vol. 13, pages 92–94, Verlag Chemie, Weinheim, New York, 4th edition, 1977).

Phosphate esters or polychlorinated aromatic compounds which can be employed for HSD hydraulic oils present no corrosion problems for they are anhydrous and do not cause high wear at highly loaded points of friction. The principal objection to the wide use of these two classes of products is, however, their extremely poor viscosity-temperature behaviour.

Furthermore, the viscosities of the triaryl phosphates and chlorinated aromatic compounds of low chlorine content exhibiting suitable high temperature stability are too low for the end uses mentioned above. Although known viscosity index improvers, such as, for example, polymethacrylates and polyolefin copolymers are known as substances exhibiting a thickening power and increasing the viscosity index of these liquids adequately, they suffer considerable loss of effectiveness at high shear rates at lubrication points.

The object of the invention consists, therefore, in adding to the synthetic base oil special polymers which have an advantageous effect on the viscosity properties thereof without appreciably impairing the flame resistance and stability under shear and are readily compatible with the base oil.

Amongst the commercially available compounds having an advantageous effect on the viscosity of lubricating oils, only polar compounds, for example polymethacrylates, are suitable. In order to achieve the desired improvements in the viscosity properties it would be necessary to use polymethacrylates of higher molecular weight which on the other hand can have an adverse effect on the stability under shear. Although low-molecular polymethacrylates affect the stability under shear less, they are less suitable at a low dosage rate for improving the viscosity properties.

It has now been found that mixtures of a highly flame-resistant base oil and a polyester of fairly high molecular weight have viscosity and shear properties satisfying the requirements mentioned above.

The subject of the invention is, therefore, a process for the preparation of liquids of low inflammability and a high viscosity index characterized by mixing 96–99.9% by weight of a highly flame-resistant base oil containing aromatic structures and 0.1–4% by weight of a polyester of fairly high molecular weight of the formula I $$\left[\mathrm{OOC{-}Y{-}CO{-}(O{-}CH_2CH_2CH_2CH_2)}_n\right]_x, \qquad \text{(I)}$$

in which Y denotes a $C_2$–$C_{40}$-alkylene radical, a cycloalkylene radical which has 5 to 40 C atoms and which consists of cyclopentyl and/or cyclohexyl radicals attached to one another, a 1,2-phenylene, 1,3-phenylene or 1,4-phenylene radical or a radical of the formula

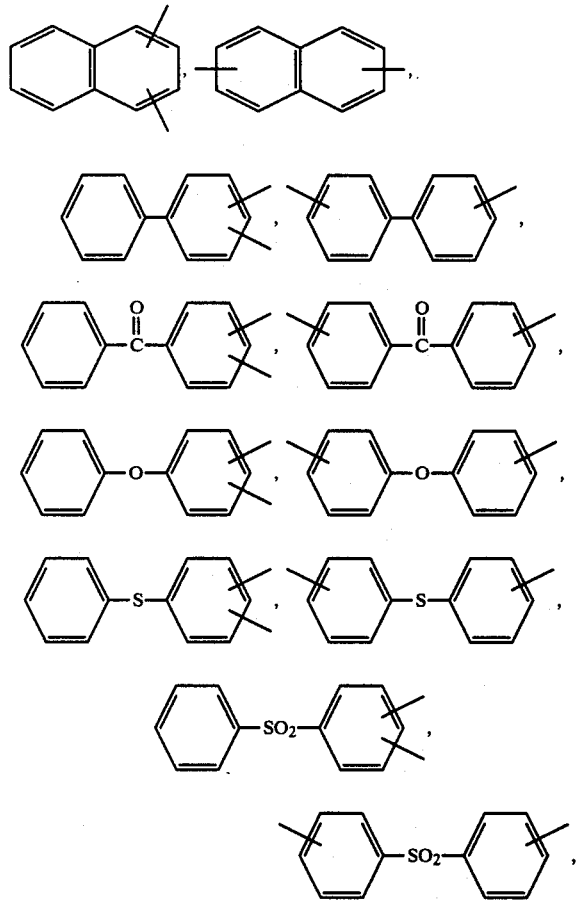

n denotes an integer from 5 to 140 and x represents a number such that the molecular weight, determined on a weight basis, gives a value from 20,000 to 300,000.

Preferred polyesters of fairly high molecular weight are those in which Y represents phenylene radicals or cycloalkylene groups and n represents a number from 9–70 and in which x is a number such that the weight average molecular weight of the polymer is a value between 30,000 and 200,000.

Polyesters of fairly high molecular weight which are particularly preferred are those in which Y = 1,4-phenylene, n = 12–50 and x is a number such that the weight average molecular weight of the polymer is a value of 40,000 to 150,000.

The weight average molecular weight $\overline{M}_w$ is determined by laser small angle light scattering. The new polyesters as described above have an adequate thickening effect, are stable at high shear rates and increase the load-bearing properties of lubricating films.

The liquids of low inflammability according to the invention are prepared by mixing the synthetic base oil with the polyester of fairly high molecular weight. The latter can be prepared by a polycondensation reaction from an aromatic or (cyclo)aliphatic dicarboxylic acid or a suitable aromatic or (cyclo)aliphatic dicarboxylic acid derivative and a polytetramethylene glycol in accordance with known processes (W. K. Witsiepe, Advan. Chem. Ser.; 1973, 129, 39–60).

Polyesters of fairly high molecular weight are used for the preparation of the liquids according to the invention. These polyesters are derivatives based on aromatic dicarboxylic acids, for example phthalic acid, isophthalic acid, terephthalic acid, naphthalic acid, naphthalene-1,4-dicarboxylic acid, naphthalene-1,5-dicarboxylic acid, biphenyl-3,4-dicarboxylic acid, biphenyl-2,2'-dicarboxylic acid, biphenyl-4,4'-dicarboxylic acid, benzophenone-3,4-dicarboxylic acid, benzophenone-2,2'-dicarboxylic acid, benzophenone-2,2'-dicarboxylic acid, benzophenone-4,4'-dicarboxylic acid, diphenyl-ether-3,4-dicarboxylic acid, diphenyl-ether-2,2'-dicarboxylic acid, diphenyl-ether-4,4'-dicarboxylic acid, diphenyl-sulphide-3,4-dicarboxylic acid, diphenyl-sulphide-2,2'-dicarboxylic acid, diphenyl-sulphide-4,4'-dicarboxylic acid, diphenylsulphone-3,4-dicarboxylic acid, diphenyl-sulphone-2,2'-dicarboxylic acid, diphenyl-sulphone-4,4'-dicarboxylic acid and the like. Reactive derivatives of these acids, for example carboxylic acid anhydrides, carboxylic acid halides, esters of low-molecular monoalcohols or monophenols, acylimidazoles and the like, are also used. Derivatives based on aliphatic dicarboxylic acids, for example succinic acid, alkylsuccinic acids, glutaric acid, adipic acid, pimelic acid, suberic acid, azelaic acid, sebacic acid, dodecanedioic acid, brassylic acid, cycloaliphatic dicarboxylic acids, for example cyclohexane-1,2-dicarboxylic acid and the anhydride thereof, cyclohexane-1,3-dicarboxylic acid and cyclohexane-1,4-dicarboxylic acid, and hydrogenated dimer fatty acids and the like, are also used.

Preferred acids are aromatic dicarboxylic acids or hydrogenated dimer fatty acids, particularly preferentially phthalic acid, isophthalic acid, terephthalic acid and hydrogenated dimer fatty acids. Terephthalic acid is very particularly preferred.

Amongst the derivatives based on dicarboxylic acids, it is preferable to use the dimethyl esters. Furthermore, the liquids according to the invention can contain customary additives, for example antioxidants (for example 2,6-di-tert.-butyl-p-cresol, 2,2'-methylene-bis(4-methyl)-6-tert.-butylphenol and the like), stabilizers (for example carbodiimides), anti-wear additives (for example zinc alkyldithiophosphates), foam-inhibiting additives and corrosion inhibitors.

Diols, for example commercially available polytetramethylene glycols, such as "Polymeg" ® (Quaker Oats) or "Teracol" ® (Dupont), are used as the alcohol component for the preparation of the polyester products according to the invention.

Polytetramethylene glycols having an average molecular weight of 360–10,000 (calculated from the hydroxyl number), preferably 650–5,000 and particularly preferably 860–3,600, are selected for the preparation of the polyesters, according to the invention, of fairly high molecular weight.

The choice of catalyst depends on the dicarboxylic acid derivative employed. It is preferred to use lower alkyl esters of titanic acid, bis-(lower alkyl)-tin oxides or tin(II) salts of aliphatic $C_2$–$C_{20}$-monocarboxylic acids as the catalyst.

The molar ratio of dicarboxylic acid derivatives to the alcohol component is approximately of accurately 1:1.

The following are examples of suitable synthetic base oils: aromatic phosphates, such as tricresyl phosphate, dicresyl monophenyl phosphate, monocresyl diphenyl phosphate and other phosphate esters of monophenols. It is also possible to use chlorinated aromatic compounds, such as trichlorobiphenyl, tetrachlorobiphenyl, pentachlorobiphenyl, trichlorodiphenyl ether, tetrachlorodiphenyl ether, pentachlorodiphenyl ether and the like, as the base oils.

The liquids of low inflammability according to the invention consisting of a base oil and a polyester of fairly high molecular weight can be generally used as lubricants and lubricant additives. They can also be employed as hydraulic fluids.

EXAMPLES

EXAMPLE 1

7,710 g of a polytetramethylene glycol having an average molecular weight of 1,000 (Polymeg ®1000), 1,500 g of dimethyl terephthalate and 2.6 g of tetra-n-butyl titanate are stirred under nitrogen at 190° C. for 2 hours (stirrer speed 150 r.p.m.) in a 20 liter autoclave which is stirred and heated by oil. The temperature is then increased to 200° C. for 1 hour. In the course of 90 minutes the pressure (normal pressure) is then gradually reduced to about 1 mbar and, at the same time, the stirrer speed is reduced to 50 r.p.m. The reaction is terminated after a further running time of 30 minutes at 1 mbar, and, after releasing the vacuum, the reaction product is discharged. A colourless, very highly viscous, transparent mass. $\overline{M}_w$ (light scattering): 79,000.

EXAMPLE 2

9,115 g of polytetramethylene glycol having an average molecular weight of 2,000 (Polymeg ®2000), 885 g of dimethyl terephthalate and 2.8 g of tetra-n-butyl titanate are subjected to polycondensation analogously to Example 1. A colourless, very highly viscous, transparent mass which solidifies to a colourless product on prolonged standing at room temperature. $\overline{M}_w$ (light scattering): 78,000

$\overline{M}_n$ (calculated from the yield of distillate): 50,000.

EXAMPLE 3

329 g of a commercially available hydrogenated dimer fatty acid (Empol ®1010; Unilever Emery), 1,171 g of a polytetramethylene glycol having an average molecular weight of 2,000 (Polymeg ®2000), 3.3 g of tetra-n-butyl titanate and 600 g of toluene are mixed and boiled under reflux for 36 hours under nitrogen at normal pressure and under a water separator (acid number before reaction 37.4 mg of KOH/g, after reaction 3.0 mg of KOH/g). The colourless, very highly viscous, transparent product is freed from toluene in vacuo. $\overline{M}_w$ (light scattering): 34,700.

USE EXAMPLES

The viscosity values of a liquid according to the invention, consisting of polymers according to Examples 1 or 2 mixed with diphenyl monocresyl phosphate or tricresyl phosphate, are shown in the table below: (DPCP=diphenyl cresyl phosphate; TCP=tricresyl phosphate).

TABLE 1

| | Kinematic viscosity at 37.8° C. ($mm^2/s$) | Kinematic viscosity at 98.9° C. ($mm^2/s$) | Viscosity index | Phosphate ester |
|---|---|---|---|---|
| Polyester according to Example 1: | | | | |
| 0% | 16.7 | 3.2 | 38 | DPCP |
| 2%* | 38.5 | 6.79 | 146 | |
| 4% | 90.7 | 14.5 | 177 | |
| Polyester according to Example 2: | | | | |
| 1% | 28.8 | 5.1 | 116 | DPCP |
| 2% | 42.3 | 7.2 | 145 | |
| 5% | 134.3 | 19.9 | 180 | |
| Polyester according to Example 3: | | | | |
| 0% | 19.7 | 3.6 | 30 | TCP |
| 2% | 26.2 | 4.45 | 69 | |
| 4% | 33.6 | 5.57 | 102 | |

*2% of polyether to 98% by weight of diphenyl cresyl phosphate; in the remaining examples the total is in all cases made up to 100% by weight analogously with diphenyl cresyl phosphate.

The superior thickening action and the effect in increasing the viscosity index can be seen clearly in Table 1.

The results of shear tests modelled on DIN 51,382 are shown in Table 2. This shows the good shear resistance of the liquids according to the invention.

TABLE 2

| Shear resistance on the model of DIN 51,382 (300 revolutions), polyesters (3% of polyester in diphenyl cresyl phosphate) | | Viscosity $mm^3/s$ at 40° C. | Viscosity $mm^3/s$ at 100° C. | Viscosity index | Viscosity loss as % of viscosity before shearing |
|---|---|---|---|---|---|
| Example 2 | before shearing | 53.1 | 9.4 | 163 | |
| 97% of diphenyl cresyl phosphate 3% of polyester, Example 2 | after shearing | 45.5 | 8.4 | 163* | at 40°:14.3 |
| Example 1 | before shearing | 49.9 | 9.0 | 163 | at 100°:11.0 |
| 97% of diphenyl cresyl phosphate 3% of polyester, Example 2 | after shearing | 46.2 | 8.45 | 161 | at 40°:7.4 |
| Example 2 | before shearing | 21.6 | 4.3 | 106 | at 100°:6.1 |
| 97% of diphenyl cresyl phosphate 3% of polyester, Example 3 | after shearing | 21.1 | 4.3 | 106 | at 40°:0 |
| diphenyl cresyl phosphate (100%) | | 14.8 | 3.15 | 55 | at 100°:0 |

What is claimed is:

1. A composition comprising 96–99.9% by weight of a highly flame-resistant base oil containing aromatic structures and 0.1–4% by weight of a polyester of the formula I $$\overline{\phantom{x}}OOC-Y-CO-(O-CH_2CH_2CH_2CH_2)_n\underline{\phantom{x}}_X, \quad (I)$$

in which Y is a radical selected from the group consisting of $C_2$–$C_{40}$-alkylene, cycloalkylene which has 5 to 40 C atoms and which contains cyclopentyl radicals attached to one another, cycloalkylene which has 5 to 40 C atoms and which contains cyclohexyl radicals attached to one another, cycloalkylene which has 5 to 40 C atoms and which contains cyclopentyl and cyclohexyl radicals attached to each other, 1,2-phenylene, 1,3-phenylene, 1,4-phenylene,

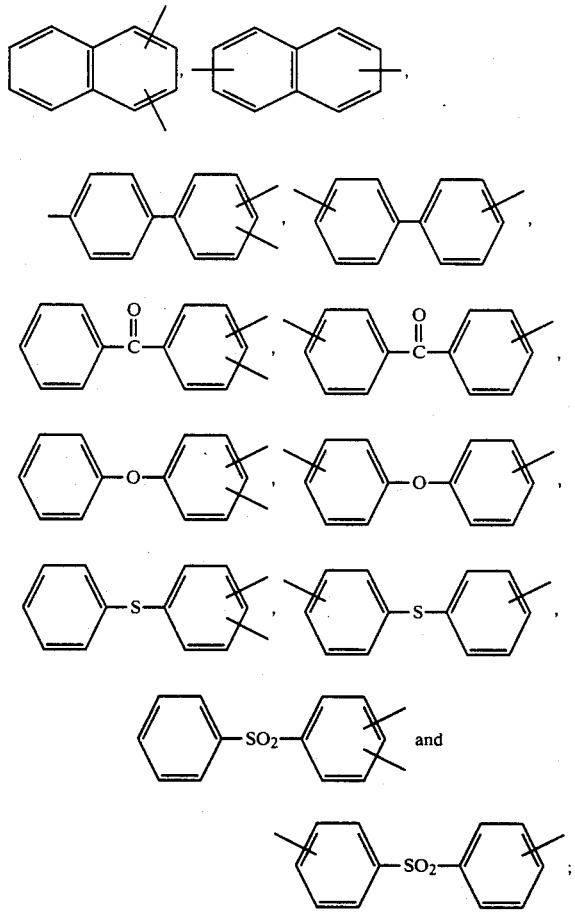

n denotes an integer from 5 to 140 and X represents a number such that the weight average molecular weight gives a value of 20,000 to 300,000.

2. A composition according to claim 1 wherein said composition is substantially free of water.

3. A composition according to claim 1 wherein said base oil is an aromatic phosphate ester or a polychlorinated aromatic compound.

4. A composition according to claim 3 wherein said base oil is a phosphate ester.

5. A composition according to claim 4 wherein said phosphate ester is selected from the group consisting of tricresyl phosphate, dicresyl monophenyl phosphate, monocresyl diphenyl phosphate and other phosphate esters of monophenols.

6. A composition according to claim 5 wherein
Y is selected from the group consisting of a phenylene radical and a cycloalkylene group; and
n represents a number from 9–70; and in which
X is a number such that the weight average molecular weight of the polymer is a value between 30,000 and 200,000.

7. A composition according to claim 6 wherein
Y is 1,4-phenylene, and
n is a value of 12–50; and
x is a number such that the weight average molecular weight of the polymer is a value of 40,000 to 150,000.

8. A composition according to claim 3 wherein said base oil is a polychlorinated aromatic compound.

9. A composition according to claim 8 wherein said polychlorinated aromatic compound is selected from the group consisting of trichlorobiphenyl, tetrachlorobiphenyl, pentachlorobiphenyl, trichlorodiphenyl ether, tetrachlorodiphenyl ether, and pentachlorodiphenyl ether.

10. A composition according to claim 8 wherein
Y is selected from the group consisting of a phenylene radical and a cycloalkylene group;
n represents a number from 9–70; and
x is a number such that the weight average molecular weight of the polymer is a value between 30,000 and 200,000.

11. A composition according to claim 10 wherein
Y is 1,4-phenylene; and
n is 12–50; and
x is a number such that the weight average molecular weight of the polymer is a value of 40,000 to 150,000.

12. A composition according to claim 7 wherein said phosphate ester is diphenyl cresylate phosphate.

13. A composition according to claim 7 wherein said phosphate ester is tricresyl phosphate.

14. A composition according to claim 1 wherein said polyester is the condensation product of polytetramethylene glycol and dimethyl terephthalate.

15. A composition according to claim 1 wherein said polyester is the condensation product of a hydrogenated dimeric fatty acid and polytetramethylene glycol.

16. A composition according to claim 1 wherein the composition has a viscosity index of at least 60, a Kinematic viscosity at 37.8° C. of at least 20, and a Kinematic viscosity at 98.9° C. of at least 5 $mm^{2/s}$.

17. A composition according to claim 1 having a viscosity index of at least 100, a viscosity of 40° C. of at least 20 $mm^{2/s}$ and at 100° C. of at least 4 $mm^{2/s}$.

18. A process for improving the viscosity index of a highly flame-resistant base oil containing aromatic structures which comprises adding 0.4 to 4% by weight to said base oil of a polyester of the formula I $$\left[OOC-Y-CO-(O-CH_2CH_2CH_2CH_2)_n\right]_x, \quad (I)$$

in which
Y is a radical selected from the group consisting of $C_2$–$C_{40}$-alkylene, cycloalkylene which has 5 to 40 C atoms and which contains cyclopentyl radicals attached to one another, cycloalkylene which has 5 to 40 C atoms and which contains cyclohexyl radicals attached to one another, cycloalkylene which has 5 to 40 C atoms and which contains cyclopentyl and cyclohexyl radicals attached to each other, 1,2-phenylene, 1,3-phenylene, 1,4-phenylene,

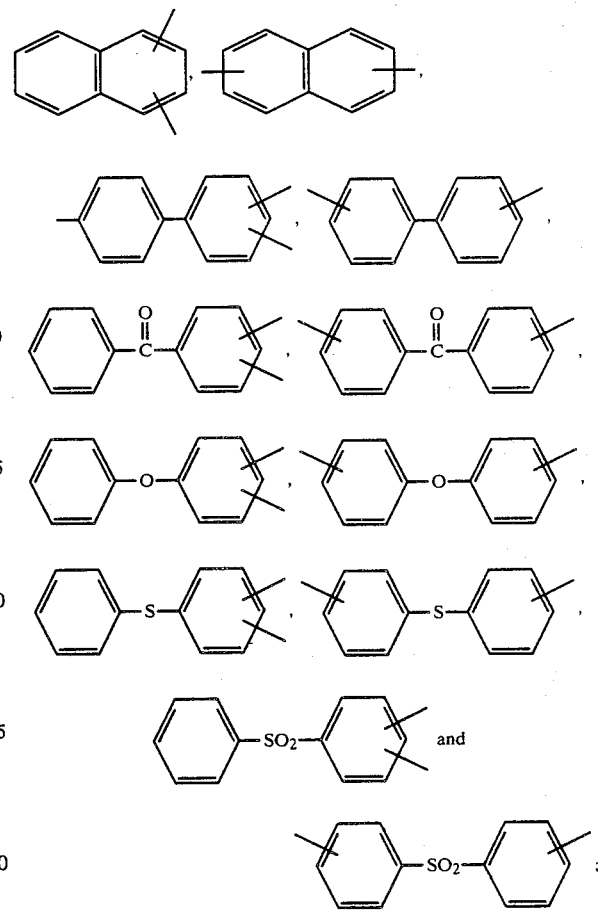

X represents a number such that the weight average molecular weight gives a value of 20,000 to 300,000.

19. In an apparatus containing a plurality of parts at least one of which is movable and is separated from an adjacent part by a lubricant, the improvement wherein said lubricant is a composition according to claim 1.

* * * * *